US010422095B2

(12) United States Patent
Fan et al.

(10) Patent No.: US 10,422,095 B2
(45) Date of Patent: Sep. 24, 2019

(54) AUTOMATIC WATER BARRIER DEVICE

(71) Applicant: NANJING JUNLI TECH. CO. LTD., Nanjing (CN)

(72) Inventors: Liangkai Fan, Nanjing (CN); Caikui Xu, Nanjing (CN)

(73) Assignee: NANJING JUNLI TECH. CO. LTD., Nanjing (CN)

( * ) Notice: Subject to any disclaimer, the term of this patent is extended or adjusted under 35 U.S.C. 154(b) by 0 days.

(21) Appl. No.: 16/073,530

(22) PCT Filed: Feb. 4, 2017

(86) PCT No.: PCT/CN2017/072874

§ 371 (c)(1),
(2) Date: Jul. 27, 2018

(87) PCT Pub. No.: WO2017/133680

PCT Pub. Date: Aug. 10, 2017

(65) Prior Publication Data

US 2019/0032293 A1 Jan. 31, 2019

(30) Foreign Application Priority Data

Nov. 8, 2016 (CN) ..... 2016 1 0980464

(51) Int. Cl.
*E02B 3/10* (2006.01)
*E06B 9/00* (2006.01)
(Continued)

(52) U.S. Cl.
CPC ..... *E02B 3/104* (2013.01); *E02B 3/10* (2013.01); *E04H 6/42* (2013.01); *E06B 9/00* (2013.01);
(Continued)

(58) Field of Classification Search
CPC . E02B 3/102; E02B 3/104; E02B 7/40; E02B 7/50; E06B 2009/007
(Continued)

(56) References Cited

U.S. PATENT DOCUMENTS 8,246,272 B1 * 8/2012 Heitz ..... E06B 9/04 405/105
2012/0163916 A1 * 6/2012 Waters, Jr. ..... E02B 3/104 405/112
2014/0169883 A1 * 6/2014 Waters, Jr. ..... E02B 3/104 405/92

FOREIGN PATENT DOCUMENTS

GB 2465005 * 4/2012
GB 2514879 * 12/2014
JP 2003227125 * 8/2003

* cited by examiner

*Primary Examiner* — Sean D Andrish
(74) *Attorney, Agent, or Firm* — CBM Patent Consulting, LLC

(57) ABSTRACT

An automatic water retaining device comprises two or more automatic water retaining units disposed in parallel, the automatic water retaining unit comprises a panel and a base, wherein the base is provided with a water storage cavity, the panel is rotatably disposed on the base, the water storage cavity is opened and closed through the rotation of the panel, a surface of the panel for covering the base is provided with a floating plate, one end of the base different from the end of the base connected with the panel is provided with a first water inlet communicated with the water storage cavity, and when water enters the water storage cavity from the first water inlet and contacts the floating plate, buoyancy is generated to the floating plate and the floating plate drives the panel to rotate and open under the action of buoyancy.

18 Claims, 24 Drawing Sheets

(51) Int. Cl.
*E04H 6/42* (2006.01)
*E06B 9/06* (2006.01)

(52) U.S. Cl.
CPC ..... *E06B 9/0638* (2013.01); *E06B 9/0653* (2013.01); *E06B 2009/002* (2013.01)

(58) Field of Classification Search
USPC ..... 405/96, 97
See application file for complete search history.

AUTOMATIC WATER BARRIER DEVICE

TECHNICAL FIELD

The present application relates to the technical field of water retaining equipment, and in particular to an automatic water retaining device.

BACKGROUND ART

In recent years, due to short-term heavy rains, the phenomenon of urban waterlogging has occurred from time to time. Especially in underground garages, a large number of vehicles have been flooded due to the inability to drain water in time. Similarly, huge property losses have been caused. The reason is that on one hand, the torrential rains in these years have become more and more fierce, and the estimation of the amount of water in the drainage design is insufficient; and on the other hand, there are technical difficulties, and it is difficult to take precautionary measures, for example, when sandbags are used previously to block the water flow and prevent it from flowing into the garage from the garage exit, the sandbags are difficult to transport.

Therefore, there is a need for a water retaining device that is convenient to mount and construct and easy to transport before mounting.

SUMMARY OF THE INVENTION

The embodiments of the present application disclose an automatic water retaining device to reduce the mounting and transportation costs while realizing a water retaining function.

Provided is an automatic water retaining device for blocking the passage of water on the ground between two side walls, comprising two or more automatic water retaining units disposed in parallel, the automatic water retaining unit comprises a panel and a base, wherein the base is provided with a water storage cavity, the panel is rotatably disposed on the base, the water storage cavity is opened and closed through the rotation of the panel, a surface of the panel for covering the base is provided with a floating plate, one end of the base different from the end of the base connected with the panel is provided with a first water inlet communicated with the water storage cavity, and when water enters the water storage cavity from the first water inlet and contacts the floating plate, buoyancy is generated to the floating plate and the floating plate drives the panel to rotate and open under the action of buoyancy, thereby implementing a water retaining function.

In the water retaining device provided by the present application, water enters the water storage cavity from the first water inlet, and when the amount of water is large, the water contacts the floating plate to generate buoyancy to the floating plate and push the panel to rotate, thereby implementing a water retaining function. Each water retaining unit has smaller structural size, thereby facilitating transportation and saving the transportation cost. The proper number of water retaining units can be selected according to the size and length of a construction site, thereby saving the processing and construction cycle of the automatic water retaining device. When the water retaining unit is used for a long time, if damage of the water retaining unit is detected, the damaged water retaining unit can be directly replaced, thereby saving the maintenance cost and maintenance cycle in the later period. In the present application, the two adjacent bases are detachably connected, so the whole water retaining device base is not of a rigid structure, and is applicable to mounting on the uneven ground.

DETAILED DESCRIPTION OF THE INVENTION

Figure 1:
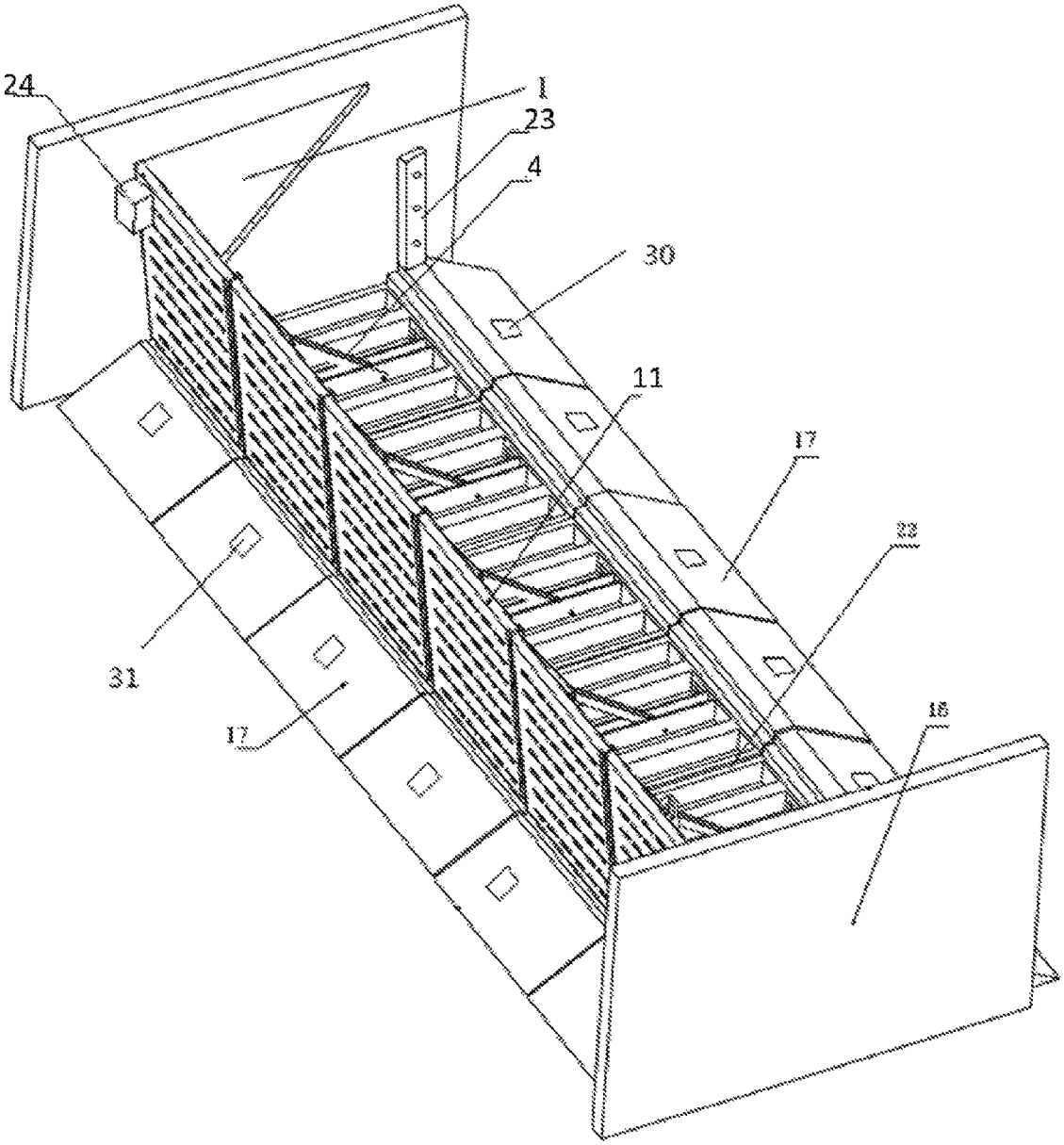
FIG. 1 is a three-dimensional structure schematic view of an automatic water retaining device in an embodiment of the present application.

In order to make the technical solutions and advantages of the present application more clear, the present invention will be further described in detail below with reference to the accompanying drawings.

The embodiment of the present application provides an automatic water retaining device. The automatic water retaining device is composed of one or a plurality of automatic water retaining units disposed in parallel, the plurality of water retaining units can be respectively transported to a construction site and spliced on the construction site, thereby implementing the mounting of the whole water retaining device.

Referring to the drawings, the automatic water retaining unit provided by the embodiment of the present application comprises a base 5 and a panel 11, wherein the base 5 is provided with a water storage cavity, the panel 11 is rotatably disposed on the base 5, the water storage cavity is opened and closed through the rotation of the panel 11, a surface of the panel 11 for covering the base 5 is provided with a floating plate 2, one end of the base 5 different from the end of the base 5 connected with the panel 11 is provided with a first water inlet communicated with the water storage cavity, and when water enters the water storage cavity from the first water inlet and contacts the floating plate 2, buoyancy is generated to the floating plate 2 and the floating plate 2 drives the panel 11 to rotate and open under the action of buoyancy, thereby implementing a water retaining function; and the two adjacent bases 5 are detachably connected.

Figure 2:
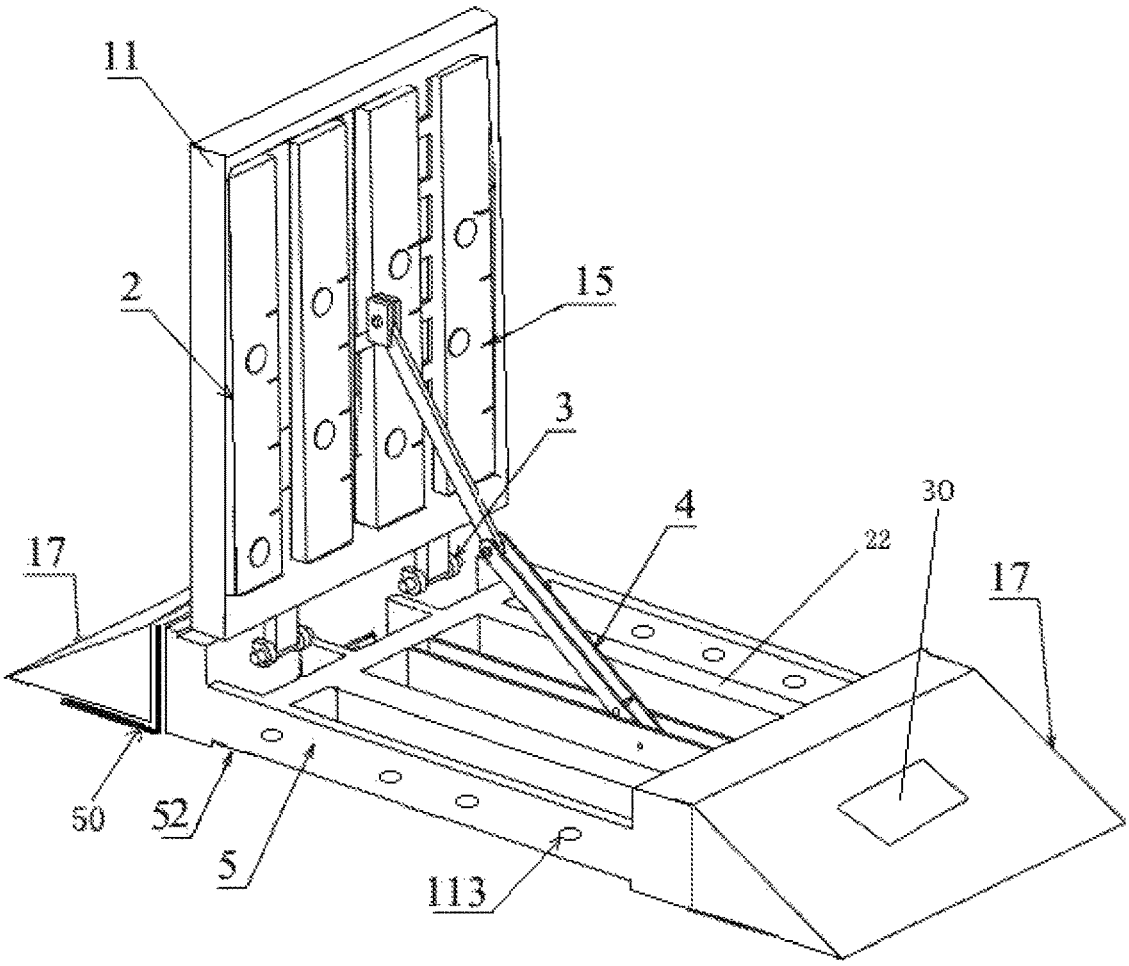
FIG. 2 is a three-dimensional structure schematic view of a water retaining unit in the automatic water retaining device in an embodiment of the present application.

As shown in FIG. 2, one end of the panel 11 is rotatably arranged on the base 5 through a hinge 3, a surface of the panel 11 for covering the base 5 is provided with a plurality of floating plates 2, one end of the base 5 different from the end of the base 5 rotatably connected with the panel 11 (one end of the base 5 different from the end of the base 5 rotatably connected with the panel 11 refers to one end of the base 5 opposite to the end of the base 5 rotatably connected with the panel 11, i.e., one end of the base that is not rotatably connected with the panel 11) is provided with a first water inlet. In the embodiment shown in FIG. 2, the base 5 is provided with four water storage cavities. It should be noted that the embodiment of the present application has no limitation on the number of water storage cavities, and one or multiple water storage cavities can be provided. When multiple water storage cavities are disposed in parallel, the water storage cavities may be separated by beams 22, as shown in FIG. 2.

Figure 3:
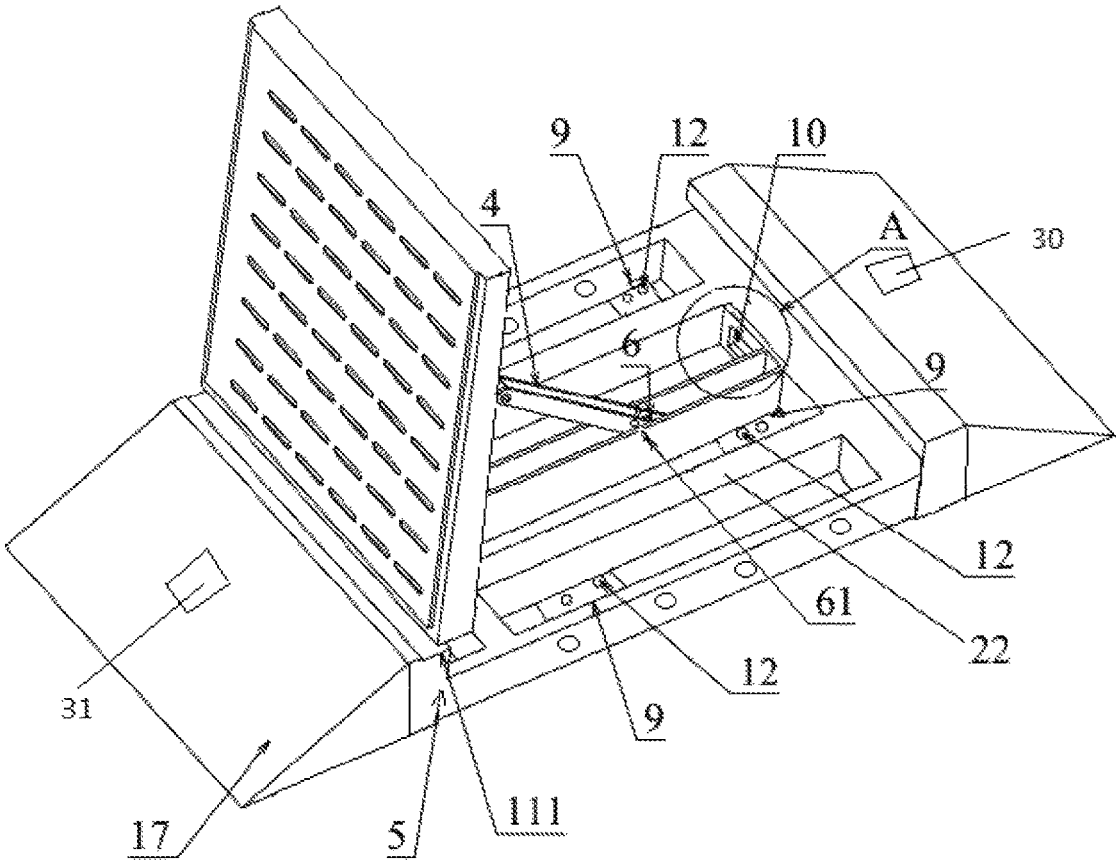
FIG. 3 is another three-dimensional structure schematic view of the automatic water retaining unit in an embodiment of the present application.
Figure 4:
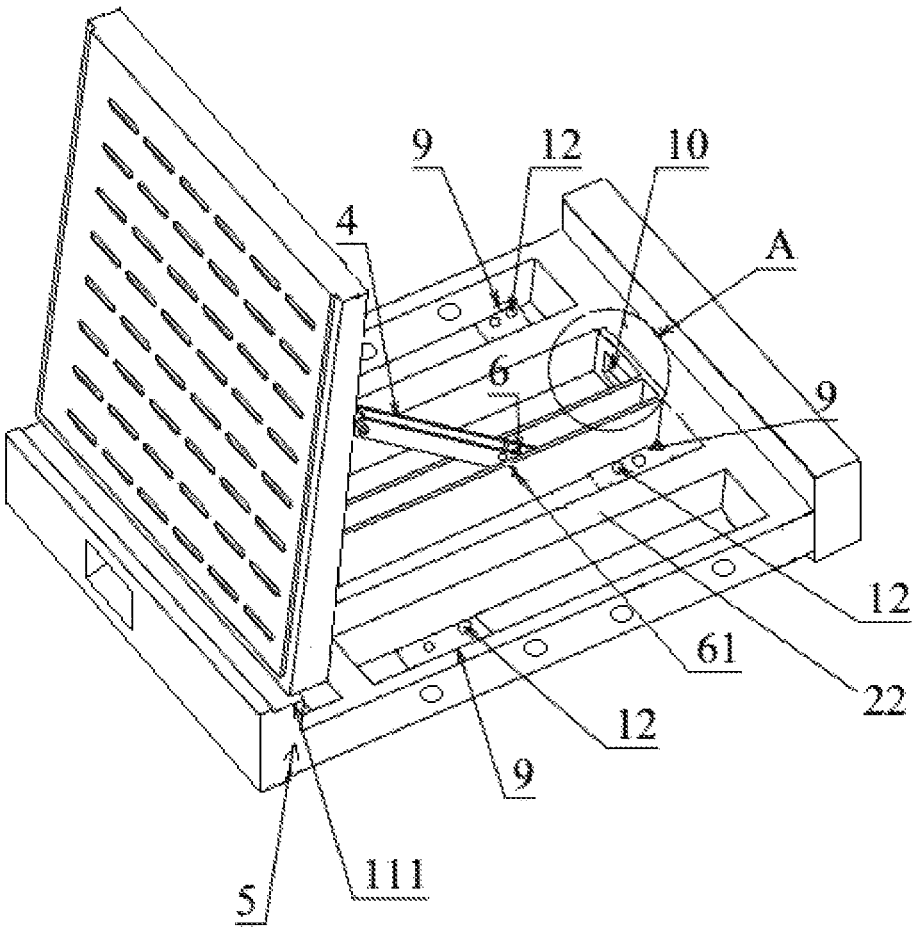
FIG. 4 is a three-dimensional structure schematic view of another water retaining unit in an embodiment of the present application.
Figure 5:
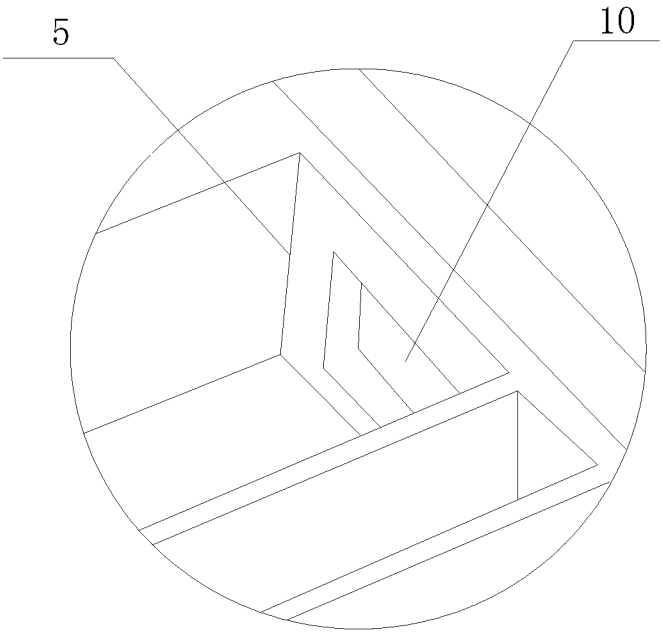
FIG. 5 is a partial enlarged view of a portion A of FIG. 3 and FIG. 4 in an embodiment of the present application.

The first water inlet 10 may be disposed on the side surface of the base 5, as shown in FIG. 3 to FIG. 5. When the amount of water is small, water can enter the water storage cavity from the first water inlet 10; and when the amount of water is relatively large, water can enter the water storage cavity of the base 5 from the first water inlet 10 and an upper space of the base 5 adjacent to the side of the first water inlet 10, and the floating plates 2 can drive the panel 11 to rotate upward around the hinge 3 under the action of buoyancy of water.

As shown in FIG. 3 and FIG. 4, in order to fix the automatic water retaining units, the bottom of each automatic water retaining unit is provided with two connecting plates 9, the upper part of the connecting plate 9 is fixed (for example, welded) to the base 5, and in use, the connecting plates 9 are detachably mounted to the ground through fasteners 12 (for example, bolts), thereby fixing the automatic water retaining units. In some embodiments, the width of each base unit and panel unit 11 is 200 mm to 1000 mm, and the transportability can be good.

In some embodiments of the present application, the base 5 is provided with through holes parallel to a rotating shaft of the panel 11, and the two adjacent bases 5 are detachably connected together through bolts disposed in the through holes. As shown in FIG. 2, a connecting surface of each base 5 with the other base 5 is provided with connecting holes 113, and in some embodiments, the connecting holes 113 are bolt connecting holes.

Figure 28:
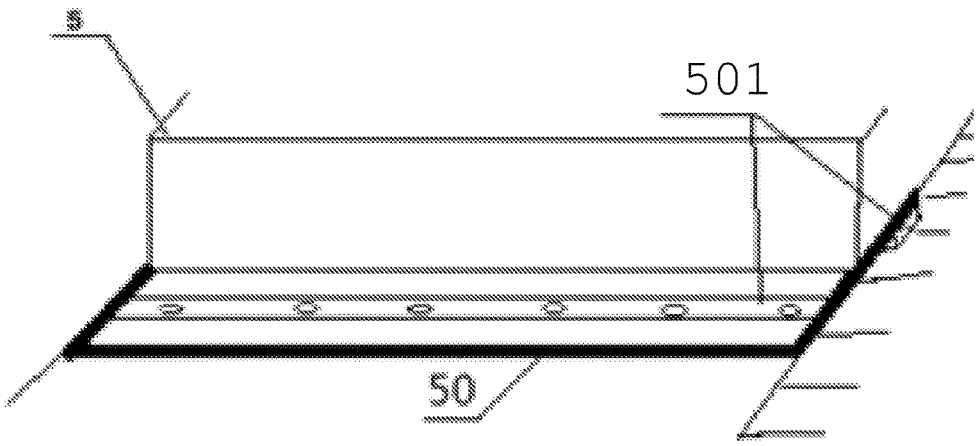
FIG. 28 is another connection structure schematic view of a base and a ground sealing strip in an embodiment of the present application.

In order to ensure that the device has a certain damping effect on vehicles passing thereover when the device is not in use (shut down), the two sides of the water retaining unit can be respectively provided with a buffer slope 17 detachably mounted on the ground through bolts. In some embodiments, the inclination of the buffer slope 17 can be 5 degrees to 45 degrees. At this time, the buffer slope 17 adjacent to the side of the first water inlet 10 is provided with a second water inlet 30, and the first water inlet 10 is communicated with the second water inlet 30, as shown in FIG. 3 and FIG. 28.

It should be noted that, in some embodiments of the present application, when the height of the automatic water retaining device can not damage the chassis and tires of an automobile, the buffer slopes 17 may not be disposed on the two sides of the base 5, for example, when the height of the automatic water retaining device in the present application is less than four to five centimeters, the buffer slopes 17 may not be disposed. As shown in FIG. 4, in the water retaining unit, the two sides of the base 5 are not provided with the buffer slopes 17, and the structure of the other components is similar to that when the buffer slopes are disposed in FIG. 3.

Alternatively, in some embodiments of the present application, the buffer slopes 17 and the base 5 may also be set as an integral mechanism, and are not provided with the second water inlet, but only provided with the first water inlet, and the first water inlet pass through the buffer slope on the side where the first water inlet is located.

In some embodiments, one end of the base 5 rotatably connected with the panel 11 may be further provided with a drainage device, as shown in FIG. 6 to FIG. 9. The drainage device can drain water accumulated in the water retaining device, thereby avoiding corroding the water retaining device. For example, after the water retaining device is mounted, especially mounted to a slope, when the panel is flattened, there will be water accumulated inside. The water accumulated inside can be drained through the drainage device, thereby avoiding corroding metal components in the device, such as metal bases.

The drainage device comprises a first water outlet 20 disposed on the base 5. In some embodiments, the drainage device may further comprise a drainage switch 21 disposed at the first water outlet 20 and linked with the panel 11; when the panel 11 covers the base 5, the drainage switch 21 is opened; and when the panel 11 rotates to open beyond a set angle, the drainage switch 21 is closed. In some embodiments, the set angle can be 3 degrees to 15 degrees. At this time, if the two sides of the base 5 are provided with the buffer slopes 17, the buffer slope 17 adjacent to the side of the first water outlet 20 is provided with a second water outlet 31, and the second water outlet 31 is communicated with the first water outlet 20. It should be noted that when the buffer slopes 17 and the base 5 are an integral mechanism, there is no second water outlet, but only the first water outlet, and the first water outlet passes through the buffer slope on the side where it is located.

The drainage switch device 21 comprises a baffle plate 211, a homocentric-square-shaped fixing plate 212, a movable door 213 and a switch spring 214, the fixing plate 212 is fixed to a position of the base 5 adjacent to the first water outlet 20, and a middle opening of the fixing plate 212 is communicated with the first water outlet 20; the movable door 213 is connected to the fixing plate 212 through a guide rod 215 over which the switch spring 214 is sleeved, one end of the switch spring 214 is fixed to the fixing plate 212, the movable door 213 and the switch spring 214 are sequentially sleeved over the guide rod 215 from outside to inside, and one end of the guide rod 215 away from the end fixed to the fixing plate 212 is fixed to one end of the switch spring 214 away from the movable door 213 through a pin (now shown); one side of the movable door 213 opposite to the switch spring is fixedly provided with an ejector rod 216, the ejector rod 216 passes through the middle part of the fixing plate 212 and extends into the other side of the fixing plate 212, the baffle plate 211 is fixed to the panel 11 and the baffle plate 211 is located on one end of the panel 11 hinged to the base 5, and the baffle plate 211 pushes the ejector rod 216 as the panel 11 rotates so that the movable door 213 slides back and forth along the guide rod 215. In some embodiments, the ejector rod 216 is provided with a thread, the movable door 213 is provided with a threaded hole, and the ejector rod 216 is fixed to the movable door 213 through the thread; and in use, the ejector rod 216 can be manually screwed in and out of the threaded hole of the movable door 213 to adjust the opening of the movable door 213, thereby implementing the adjustment of the drainage capacity.

When the drainage switch 21 is used for flattening the panel 11, the baffle plate 211 abuts against the ejector rod 216 so as to drive the movable door 213 to compress the switch spring 214, the movable door 213 leaves the fixing plate 212, the first water outlet 20 is opened and is in the drainage state to discharge the residual water, thereby avoiding corroding the metal base; and when the panel 11 floats up, the switch spring 214 compresses the movable door 213, the movable door 213 is closely attached to the fixing plate 212, and the first water outlet 20 is closed to avoid water drainage. In some embodiments, the ejector rod 216 is a flat-nosed screw, so that the baffle plate 211 has a larger contact area with the ejector rod, and the ejection effect is better.

Besides, in addition to enabling the water accumulated in the water retaining device to be drained and avoiding corroding the water retaining device, the drainage device can also prevent the water retaining device from prematurely blocking the inlet passage and affecting the passage of vehicles. At this time, the water inlet capacity of the first water inlet 10 is greater than the drainage capacity of the first water outlet 20. When the water quantity at the inlet is less than the drainage capacity of the first water outlet 20, water entering the water storage cavity can be drained from the first water outlet 20, and the water retaining plate formed by the panel 11 is in the closed state, so that the vehicles can pass normally. Only when the water inlet amount is greater than the drainage capacity of the first water outlet 20, there will be water accumulated in the water storage cavity, and the front end of the panel 11 is opened upward along the hinge 3. In some embodiments, when the panel 11 floats up, the switch spring 214 in the drainage switch 21 compresses the movable door 213, the movable door 213 is closely attached to the fixing plate 212, and the first water outlet 20 is closed to avoid drainage.

Figure 10:
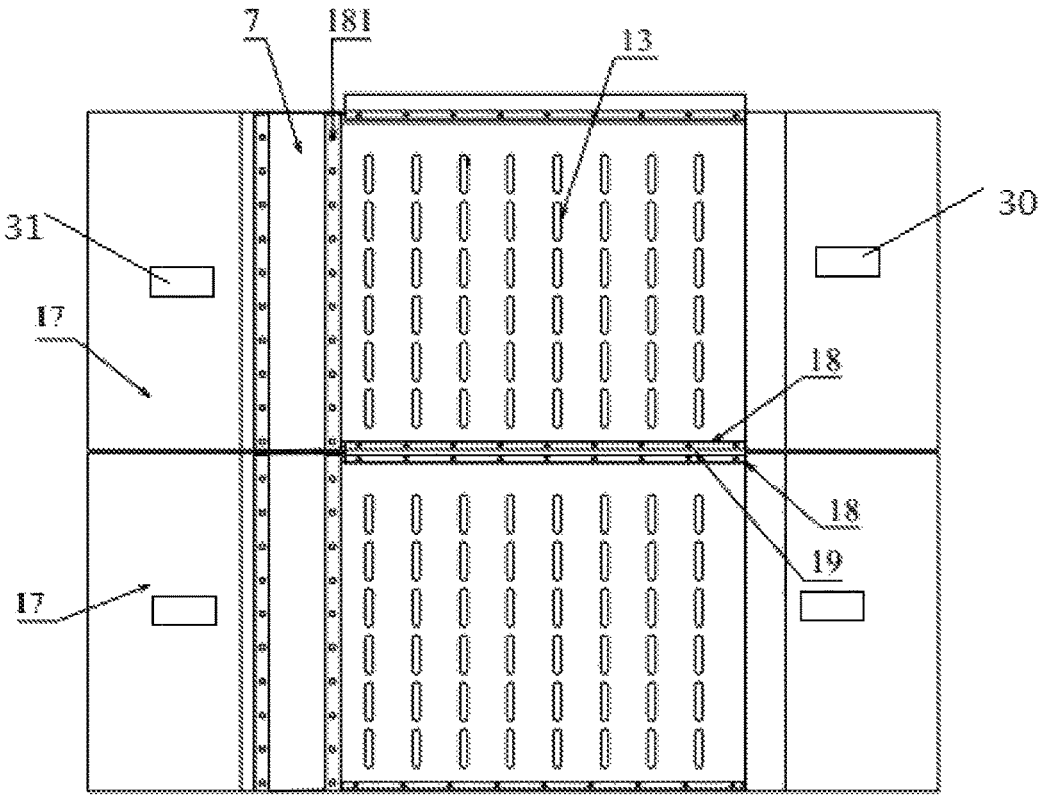
FIG. 10 is a connection structure schematic view of two automatic water retaining units in an embodiment of the present application.

In some embodiments, the two adjacent panels 11 are connected through a sealing device formed by two hold-down strips 18 compacting one flexible sealing strip 19, each flexible sealing strip 19 is overlapped on the two adjacent panels 11, and the two hold-down strips 18 are respectively fixed to the two panels 11 through bolts and press the two sides of the flexible sealing strip 19, as shown in FIG. 10. The flexible sealing strip 19 may be made of silicone rubber or a flexible metal sheet; and in some embodiments, the material of the flexible sealing strip 19 is in a two-layer structure, the bottom layer is 4 mm-thick silicone rubber, and the surface layer is a 0.3 mm stainless steel sheet.

At the position of the panel 11 hinged to the base 5, the panel 11 and the base 5 are sealed through a rear sealing device composed of two rear hold-down strips 181 and a rear flexible sealing strip 7, two sides of the rear flexible sealing strip 7 are respectively overlapped on the panel 11 and the base 5, the two rear hold-down strips 181 are respectively fixed to the panel 11 and the base 5 through bolts, and the two rear hold-down strips 181 respectively compact the two sides of the rear flexible sealing strip 7 to be attached to the panel 11 and the base 5, thereby implementing the sealing between the panel 11 and the base 5. In some embodiments, the material for manufacturing the rear flexible sealing strip 7 is 4 mm-thick silicone rubber, so the sealing effect is better and the service time is longer.

Figure 11:
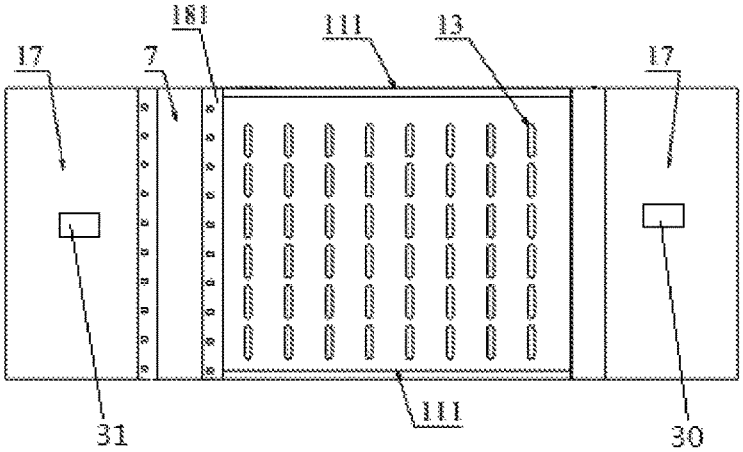
FIG. 11 is a three-dimensional structure schematic view of a panel in an automatic water retaining unit in an embodiment of the present application.

Besides, in order to simplify the mechanism, save the space and keep the panel joint and the panel surface flat, second grooves 111 recessed toward the base 5 are respectively disposed on three edge positions of each panel 11 adjacent to the hinge 3, as shown in FIG. 11, and the flexible sealing strip 19 and the rear flexible sealing strip 7 are disposed in the second grooves 111; and the hold-down strip 18 and one of the rear hold-down strips 181 are also fixed to the panel 11 through bolts, so that when the panel 11 covers the base 5, the tops of the hold-down strip 18 and the rear hold-down strip 181 are located on the same plane as the top of the panel.

Figure 12:
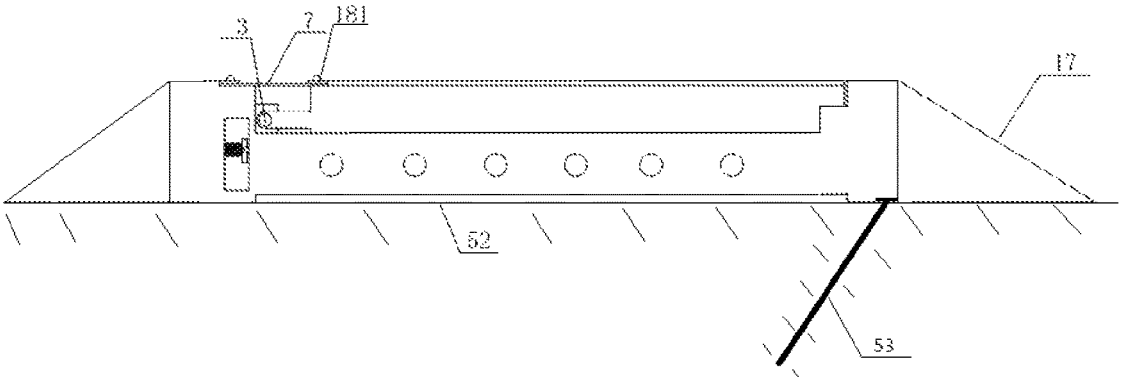
FIG. 12 is a top view of a panel of the automatic water retaining unit in an embodiment of the present embodiment.

As shown in FIG. 12, a gap 52 is disposed between the bottom of each beam 22 and the ground, the gap can well ensure that the beam 22 and the floating plates 2 do not contact the ground so that water can enter the bottom, and the water storage cavities are communicated with each other so as to generate uniform buoyancy on the panel 11. One end of each base 5 adjacent to the first water inlet 10 is provided with an oblique nail 53 for fixing the end of the base 5 to the ground, the oblique nail 53 is inclined toward the other end of the base 5 to prevent the base from turnover, and the number of oblique nails 53 on each base 5 may be one or multiple.

In the present embodiment, there are many ways for the water storage cavity to be communicated with the first water inlet 10, in addition to the above-mentioned way that the bottom of the beam 22 is provided with a gap and one of the water storage cavities is communicated with the first water inlet, it is also possible that the number of the first water inlets is set to be the same as the number of the water storage cavities, each water storage cavity is communicated with one first water inlet and the number of the first water inlets is the same as the number of the second water inlets.

Figure 6:
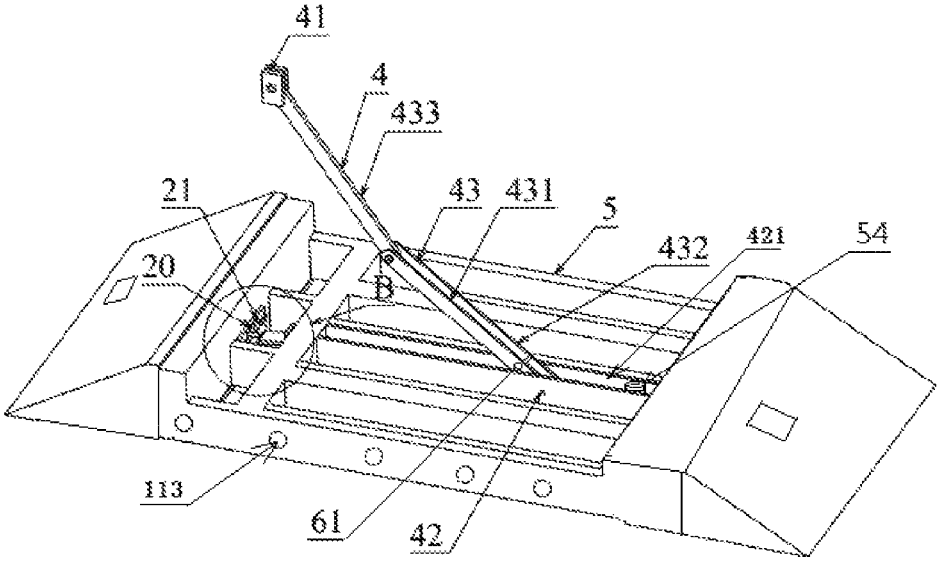
FIG. 6 is a three-dimensional structure schematic view of a drainage device in an embodiment of the present application.
Figure 7:
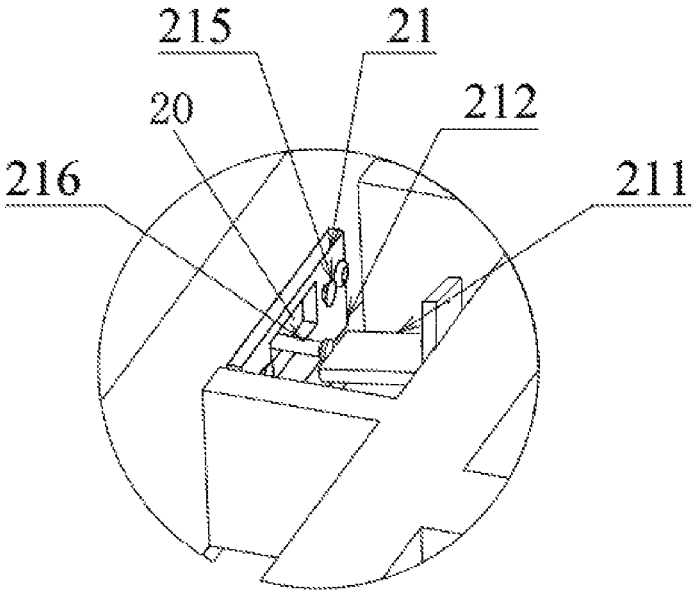
FIG. 7 is an enlarged schematic view of the structure of a portion B in FIG. 6 in an embodiment of the present application.
Figure 8:
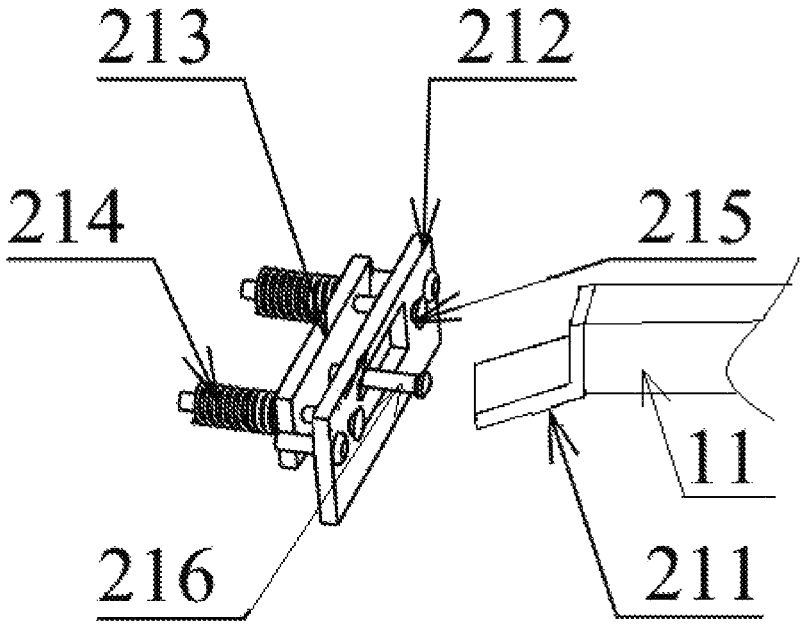
FIG. 8 is a three-dimensional structure schematic view of a drainage switch device in FIG. 7 in an embodiment of the present application.
Figure 9:
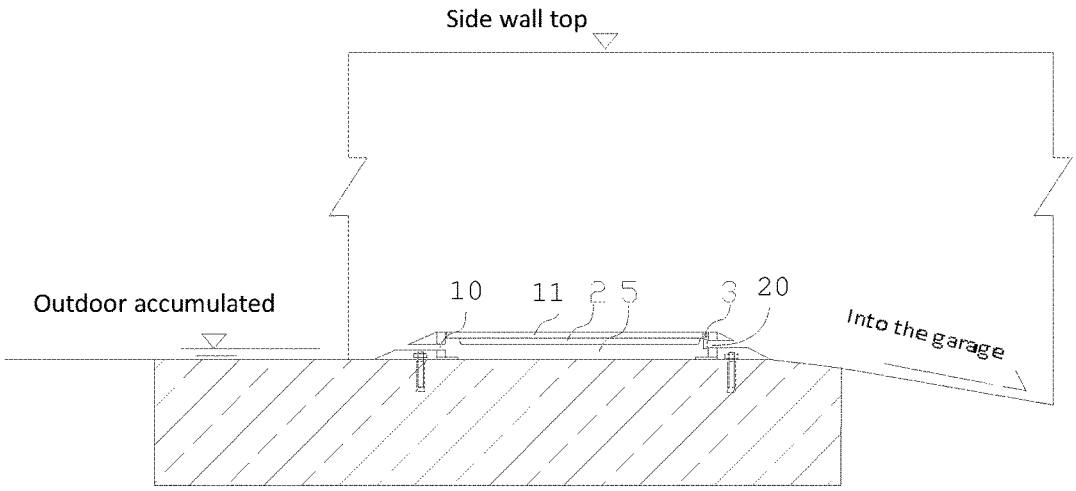
FIG. 9 is another schematic view of a drainage device in an embodiment of the present application.

As shown in FIG. 6, one end of the base 5 adjacent to the first water inlet 10 is provided with an elastic device 54 capable of contacting the panel, so that after the panel 11 covers the base, the panel 11 presses the spring and the spring generates an upward force, thereby facilitating the floating of the panel. In some embodiments, the above elastic device 54 is a spring, and is disposed in a groove 421; and the spring is mounted in the groove 421 and produces a moderate elasticity within the retractable range, so that the panel and the base can not automatically bounce off in normal use. The number of the springs in the present application may also be two or more, and a proper number of springs can be set according to actual demands.

In the above embodiment, each panel 11 is provided with a connecting device 4 which is respectively connected with the base 5 and used for pulling the panel 11 when the panel 11 floats up; and thus, the panel 11 can be supported when completely floating up, and can fall down only by manual intervention when not used for water retaining, thereby preventing the sudden closing from hurting people around.

Figure 13:
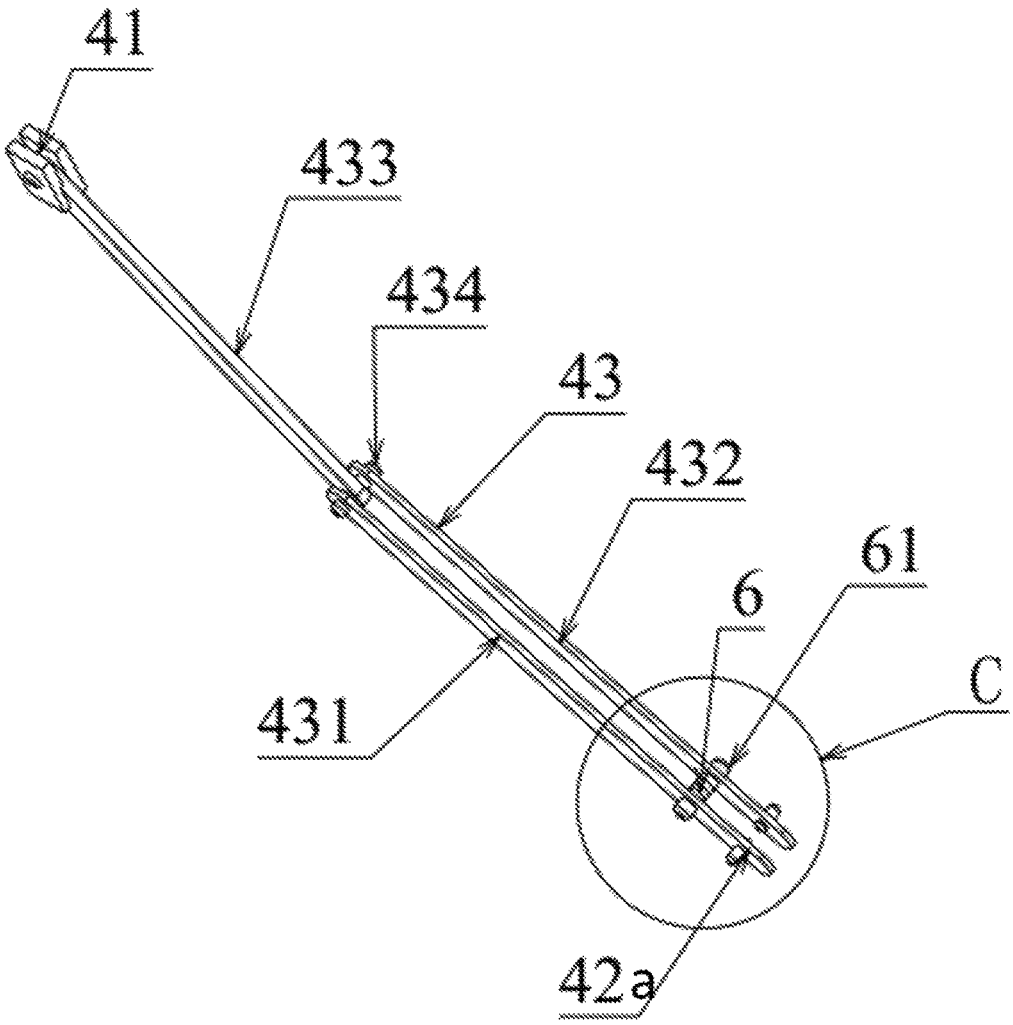
FIG. 13 is an enlarged three-dimensional structural view of a connecting device in FIG. 2 in an embodiment of the present application.
Figure 14:
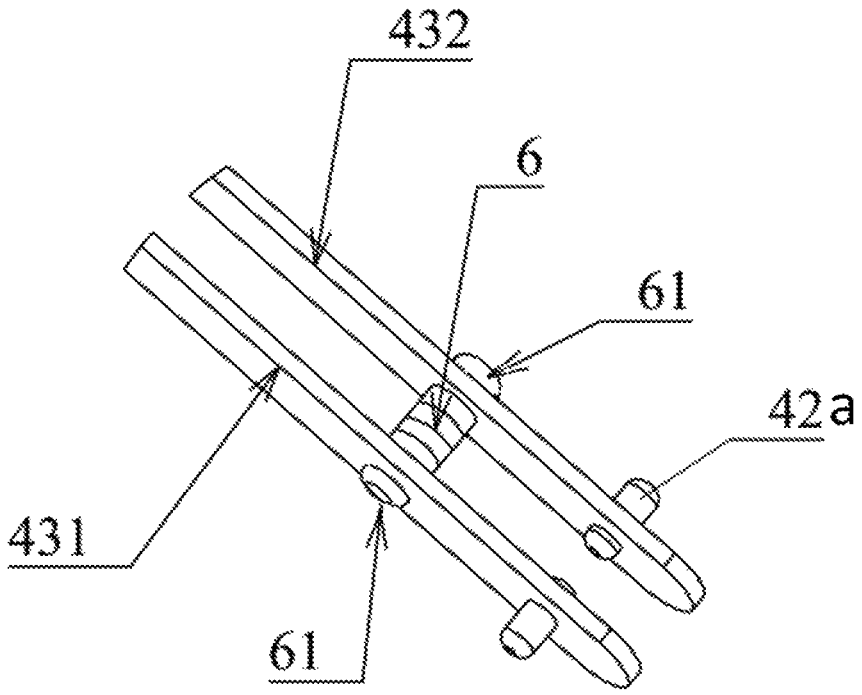
FIG. 14 is a detailed enlarged view of a portion C in FIG. 13 in an embodiment of the present application.

As shown in FIG. 6, FIG. 13 and FIG. 14, each connecting device 4 comprises an upper fixing portion 41 disposed on the panel 11 and a lower fixing portion 42 disposed on the base 5, a connecting rod 43 is further disposed between the upper fixing portion 41 and the lower fixing portion 42, and the connecting rod 43 is foldable. The top of the beam 22 rotatably connected with the lower connecting rod is provided with a groove 421 disposed along the longitudinal direction of the beam, and the groove 421 constitutes the lower fixing portion 42; the connecting rod 43 comprises a left lower connecting rod 431, a right lower connecting rod 432, an upper connecting rod 433, a hinge 434, a left lower connecting rod 431, a right lower connecting rod 432 and an upper connecting rod 433 which are respectively rotatably connected through the hinge 434 and fold or unfold by using the hinge 434 as a pivot, and the left lower connecting rod 431 and the right lower connecting rod 432 are respectively located on two sides of the upper connecting rod 433; and the left lower connecting rod 431 and the right lower connecting rod 432 are respectively connected with the inside of the groove 421 rotatably disposed on the lower fixing portion 42 through an axis pin 42*a*, a position between the left lower connecting rod 431 and the right lower connecting rod 432 adjacent to the base 5 is also connected with a transverse spring 6, one side of a position where the left lower connecting rod 431, the right lower connecting rod 432 and the base 5 are connected, which is different from the side of the transverse spring 6, is provided with a cup-headed flange 61 extending outward (i.e., the transverse spring and the cup-headed flange 61 are located on two opposite sides on the left lower connecting rod 431 or the right lower connecting rod 432), and the cup-headed flange 61 is located between the axis pin 42*a* and the hinge 434. In the present application, the number of water storage cavities is one more than the number of the beams. If the number of the beams is multiple, one of the beams may be optionally provided with a groove 421 for rotatably connecting with the left lower connecting rod 431 and the right lower connecting rod 432.

After the panel 11 completely floats up, the cup-headed flange 61 on the outer sides of the left lower connecting rod 431 and the right lower connecting rod 432 expand outward under the action of the springs 6, the cup-headed flange 61 is exposed out of the groove 421 inside the beam, and the cup-headed flange 61 abuts against the top edge of the groove 421, thereby limiting the left lower connecting rod 431 and the right lower connecting rod 432 from rotating downward; thus, after water retreats, the floating plates 11 cannot cover down due to the dead weight, and it is necessary to manually push the panel 11 downward such that the cup-headed flange 61 can contract inward to enter the groove 421, and the left lower connecting rod 431 and the right lower connecting rod 432 rotate downward; and at this time, the upper connecting rod and the lower connecting rod are folded together and received in the groove 421, so that the panel 11 can be closed, thereby preventing the sudden closing of the panel 11 from hurting people around.

Figure 15:
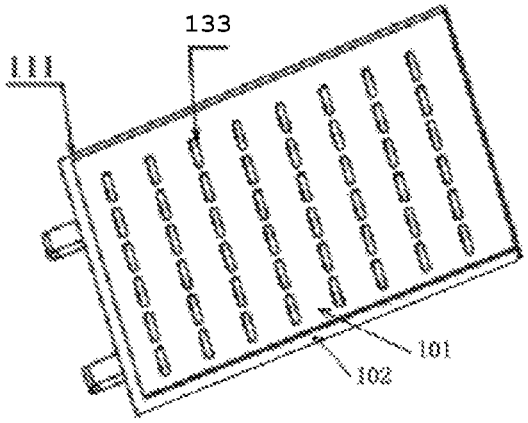
FIG. 15 is another structure schematic view of the panel of the automatic water retaining unit in an embodiment of the present application.
Figure 16:
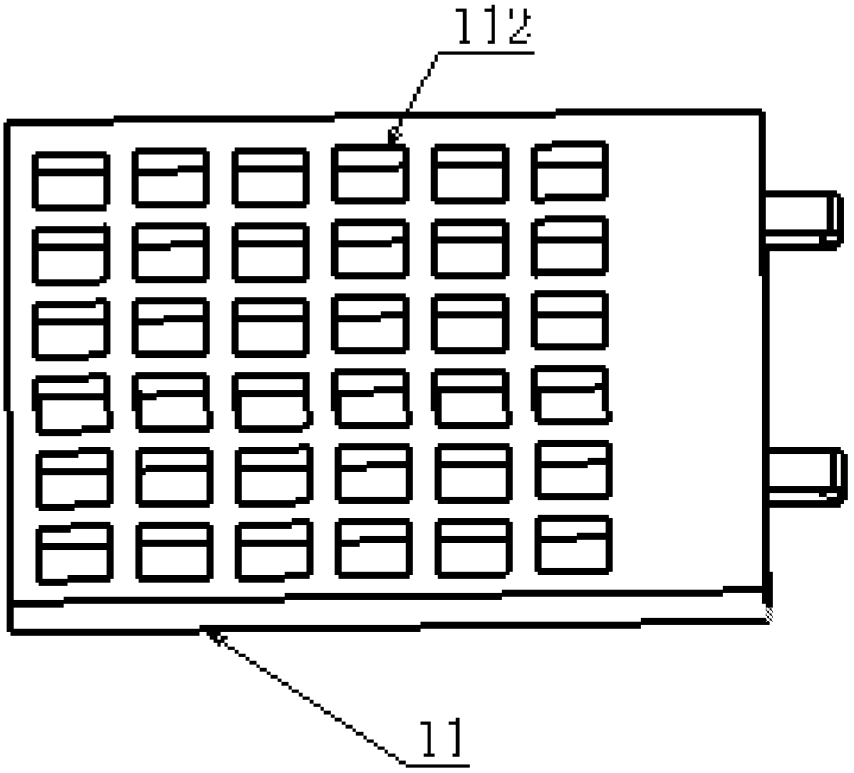
FIG. 16 is another structure schematic view of a panel of the automatic water retaining unit in an embodiment of the present application.
Figure 17:
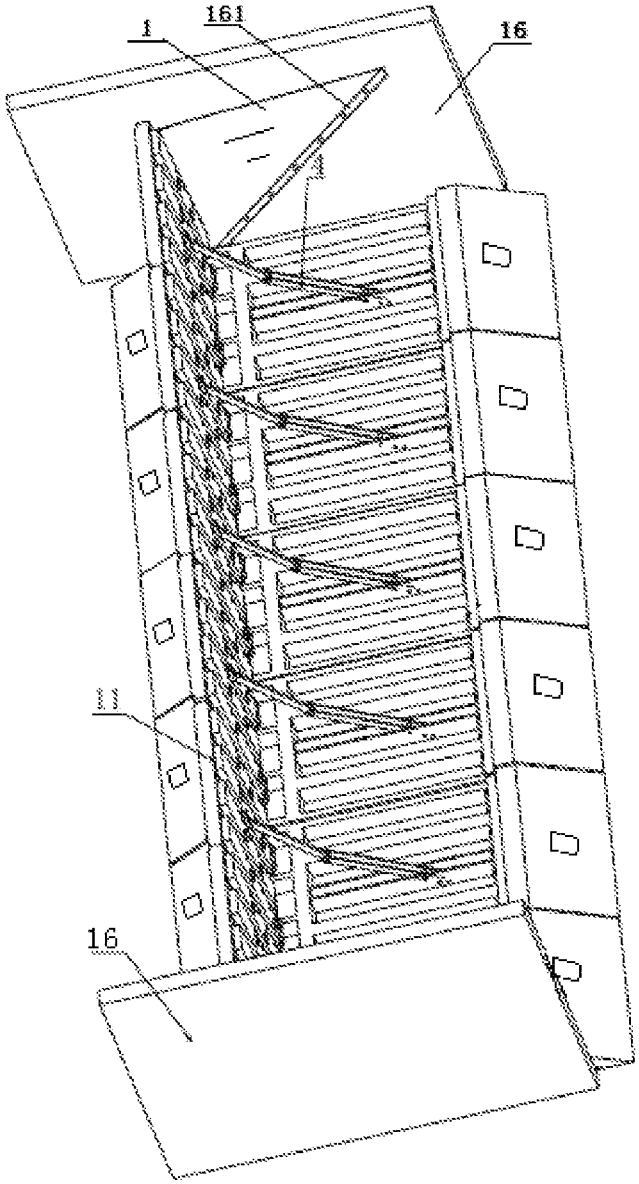
FIG. 17 is a schematic view of a mounting manner of a sealing plate in an embodiment of the present application.
Figure 18:
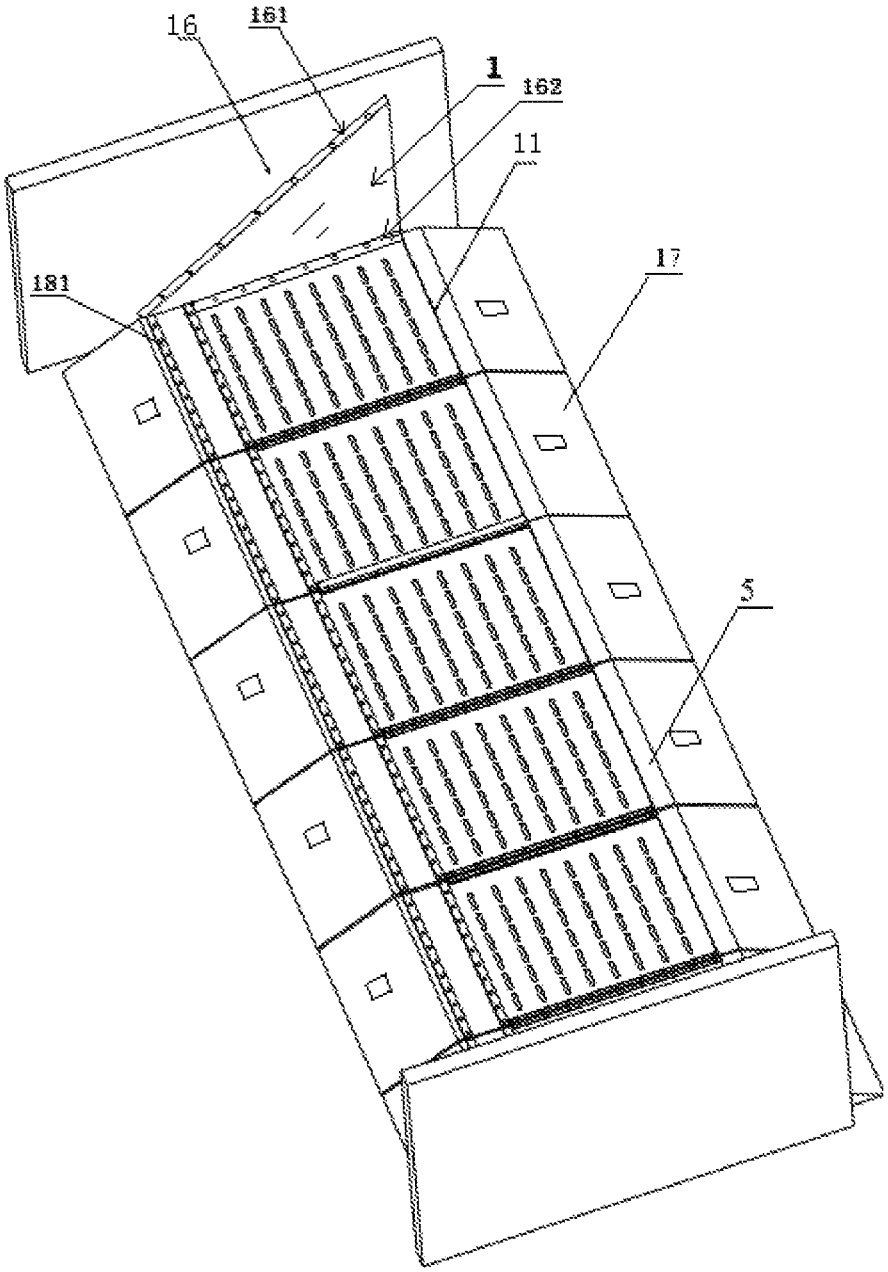
FIG. 18 is another schematic view of a mounting manner of a sealing plate in an embodiment of the present application.
Figure 19:
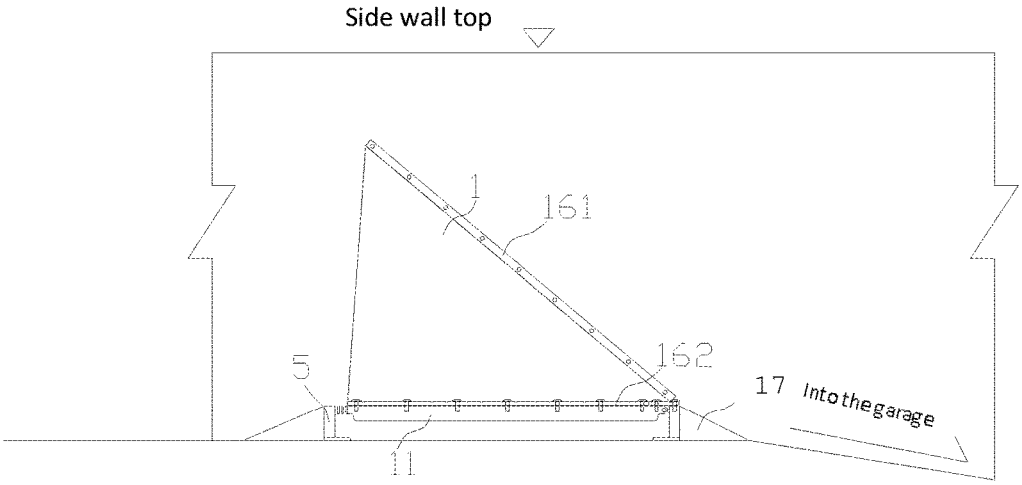
FIG. 19 is another schematic view of the mounting manner of the sealing plate in an embodiment of the present application.
Figure 20:
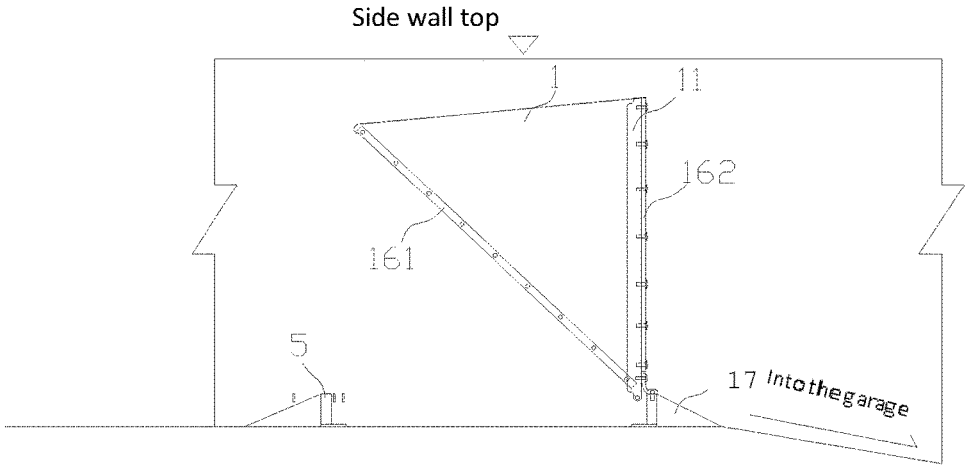
FIG. 20 is another schematic view of the mounting manner of the sealing plate in an embodiment of the present application.

As shown in FIG. 15 and FIG. 16, the panel 11 in the present application comprises an upper panel 101 on the upper layer and a lower panel 102 on the lower layer, the lower panel 102 is rotatably disposed on the base through a hinge 3, the upper panel 101 is detachably mounted on the lower panel 102 through rivets, the floating plates 2 are fixed to the lower panel 102 and the lower panel 102 is also provided with a plurality of lightening holes 112, and the floating plates 2 and the lightening holes 112 are respectively located on the surface of the lower panel 102 covering the base. In some embodiments, the panel 11 is made of aluminum, and is light in weight. The lightening holes 112 are filled with a buoyancy material (a material being light in weight, being more buoyant in water and floating on water) capable of generating buoyancy of water, and in some embodiments, the buoyancy material may be foam made of polyurethane.

The upper surface of the upper panel 101 is also provided with concave grains 133 or convex grains, thereby enhancing a certain friction force for the passing vehicles, preventing the vehicles passing over the water retaining device from slipping in rainy or snowy weather, and having favorable antiskid effects. As shown in FIG. 2, one side of the floating plate 2 facing the base 5 is also provided with a water level warning mark 15. The water level warning mark 15 is a scale display or a warning color display. When the panel 11 floats up, working personnel or other people around can be reminded to raise the water retaining device or properly drain the water. It can also play a better warning role for the entering vehicles. The floating plates 2 in the present application may be made of water-resistant foam, and thus, has longer service life.

In the above embodiment, the two sides of the automatic water retaining device are wall surfaces, and in order to prevent the clearance leakage between the water retaining device and the side walls, the automatic water retaining device may further comprise flexible sealing plates respectively disposed between both sides of the automatic water retaining device and both side walls, wherein the flexible sealing plates are respectively fixedly connected to the side walls and the panel 11 of the automatic water retaining unit adjacent to the side walls in the automatic water retaining device, and after the panel 11 floats up, the flexible sealing plates are driven to bend therewith to implement a water retaining function between the two sides of the automatic water retaining device and the two side walls, thereby preventing the clearance leakage between the water retaining device and the side walls.

As shown in FIG. 17 to FIG. 20, a triangular flexible sealing plate 1 may be disposed between the automatic water retaining unit at the end of the automatic water retaining device and the wall 16, the flexible sealing plate 1 may be made of silicone rubber, the bottom side thereof is detachably mounted to the wall 16 through the sealing plate wall surface hold-down strip 161, and a waist side is detachably mounted to the panel 11 adjacent to the wall surface through a sealing plate panel hold-down strip 162, thereby implementing the favorable sealing effect between the panels 11 on the two ends and the wall 16. In some embodiments, the sealing plate wall surface hold-down strip 161 on the wall 16 and the base form a 45-degree angle, and the bottom end of the sealing plate wall surface hold-down strip 161 is close to the end of the outermost rear hold-down strip 181; the sealing plate wall surface hold-down strip 161, the wall surface anti-leakage flexible sealing plate 1, the sealing plate panel hold-down strip 162 and the panel 11 form a complete wall surface anti-leakage flexible sealing cavity; and after the panel 11 floats up, the flexible sealing plate 1 is driven to bend therewith, thereby avoiding affecting the anti-leakage sealing effect of the wall surface. In some embodiments, the flexible sealing plate 1 is in a shape of a right-angled triangle, one leg of the right-angle triangle is fixed to an upper edge of the panel, and the hypotenuse is fixed to the wall surface 16.

Figure 21:
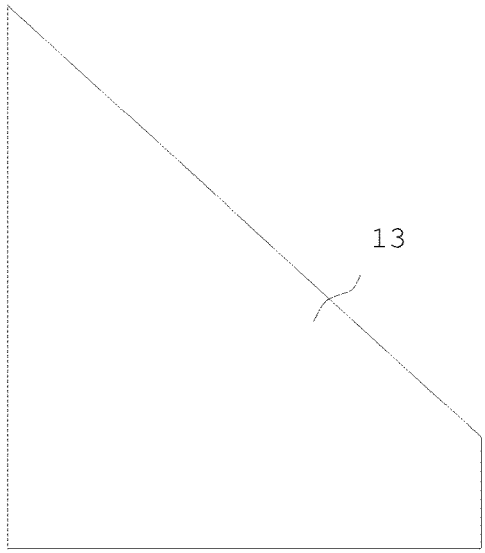
FIG. 21 is a plan view of the sealing plate in an embodiment of the present application.
Figure 22:
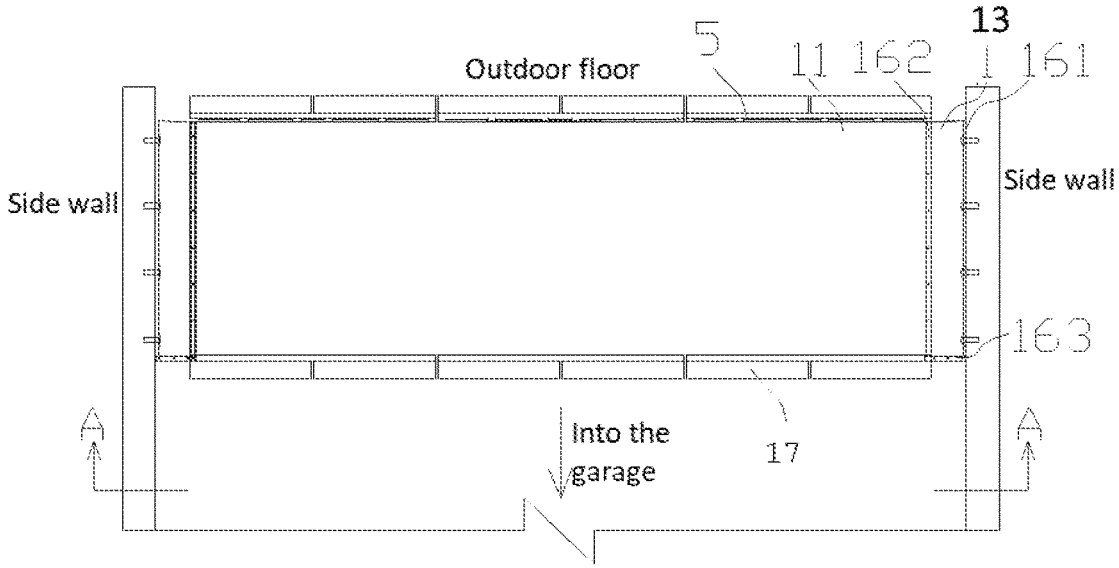
FIG. 22 is a top view of the water retaining device in an embodiment of the present application.
Figure 23:
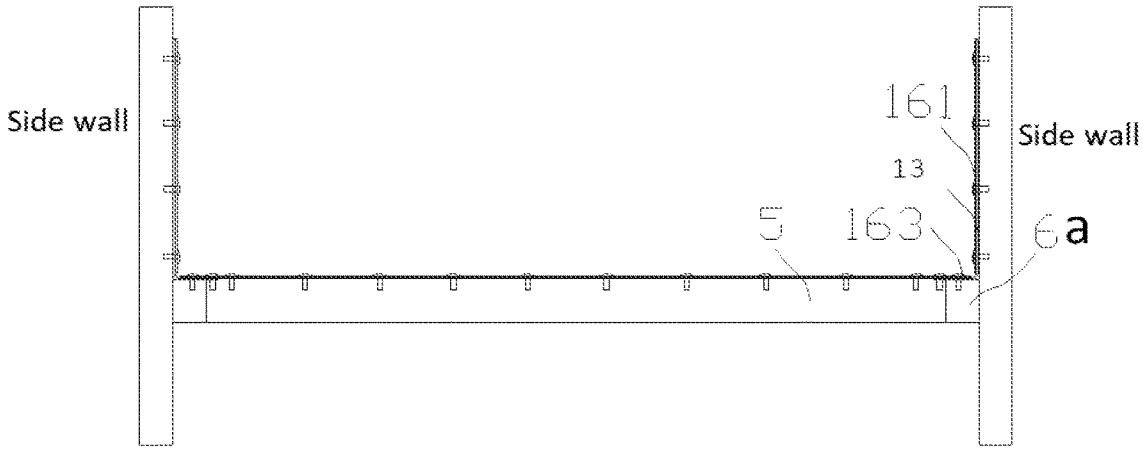
FIG. 23 is an A-A view of the water retaining device in FIG. 22.

In order to ensure the sealing effect between the water retaining device and the two side walls, the distance between the water retaining device and the two side walls is required to be small enough to ensure the sealing effect of the sealing plate. This requires a very precise measurement of the distance between the two side walls, and also very precise processing of the width of the water retaining device. Although a combination of different number of water retaining units can be used to achieve different widths of the water retaining device, it is still difficult to achieve the sealing between the water retaining device and the two side walls. Therefore, in some embodiments, a right-angled trapezoidal flexible sealing plate 13 may be disposed between the automatic water retaining unit at the end of the automatic water retaining device and the wall 16, as shown in FIG. 21 to FIG. 23, the water retaining device of the present embodiment further comprises two right-angled trapezoidal flexible sealing plates 13 respectively disposed on two sides of the water retaining device, the beveled sides of the sealing plates 13 are fixedly connected to the side wall, a right-angle side is fixedly connected to one end of the panel 11 adjacent to the side wall, and the top side is flush with the rear edge of the base 5 and is hermetically connected with the ground.

In some embodiments, the water retaining device further comprises a wall surface hold-down strip 161 and a panel hold-down strip 162, the base angle of the beveled side of the sealing plate 13 is 45 degrees, the wall surface hold-down strip 161 fixes the beveled side of the sealing plate 13 to the side wall 16 along the side wall surface by 45 degrees, and the panel hold-down strip 162 is parallel to the side wall surface and fixes the right-angle side of the sealing plate 13 to the upper surface of the panel 11.

The sealing plate 13 is a flexible material, and can be cut by a constructor on a construction site to adjust the width of the top side, so that the width of the top side of the sealing plate 13 is equal to the sum of the distance between the outermost side of the base and the side wall and the width of the panel hold-down strip, thereby greatly facilitating the site mounting construction and enhancing the adaptability of the product.

The number of the water retaining units is not less than two, and the panels 11 fixedly connected to the right-angle sides of the sealing plates 13 are panels of the two water retaining units of the water retaining device respectively adjacent to the two side walls.

When there is only one water retaining unit, the two ends of the unit are hermetically connected with the two side walls through the sealing plates 13. When there are multiple water retaining units, the outer sides of the panels of the two water retaining units respectively adjacent to the two side walls are hermetically connected with the two side walls through the sealing plates 13.

Figure 24:
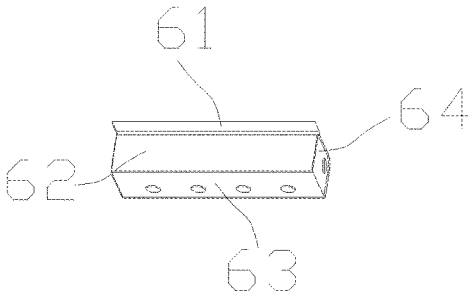
FIG. 24 is a structure schematic view when the gap filler is a Z-shaped strip in an embodiment of the present application.

In some embodiments, a gap filler **6*a* having the same height as the base 5 is further disposed between the base 5 adjacent to the side wall 16 and the side wall, as shown in FIG. 24. One end of the gap filler 6*a* abuts against the side wall 16, the other end is hermetically fixedly connected to the base 5, the lower surface is hermetically fixedly connected to the ground, and the top side of the sealing plate 13 is disposed on the upper surface of the gap filler 6*a* and fixes the top side of the sealing plate 13 to the gap filler 6*a* through a gap filler hold-down strip 163**.

The gap between the base 5 and the side wall 16 is filled with the gap filler **6*a*, and the gap between the panel 11 and the side wall 16 is filled with the sealing plate 13, thereby ensuring the completeness and effectiveness of the whole water retaining scheme, lowering the construction difficulty of the top side of the sealing plate 13 and prolonging the service life of the sealing plate 13. Since the sealing plate 13 is the most vulnerable part in the whole water retaining device, the prolonging of the service life of the sealing plate 13** can prolong the service life of the whole water retaining device.

Figure 25:
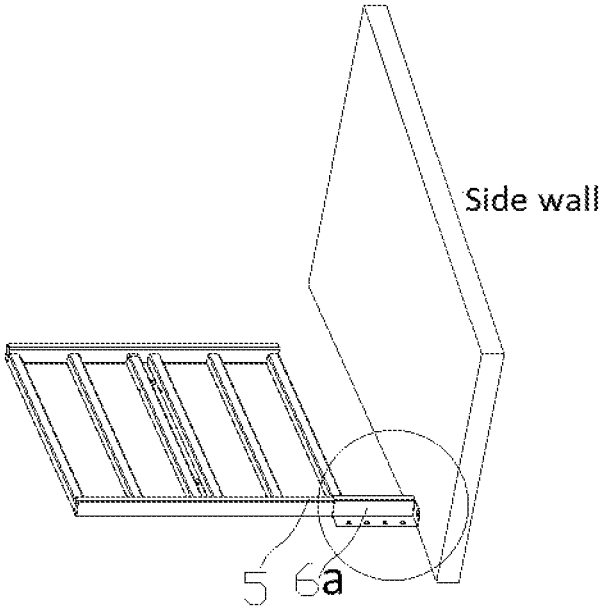
FIG. 25 is a mounting schematic view when the gap filler is a Z-shaped strip in an embodiment of the present application.
Figure 26:
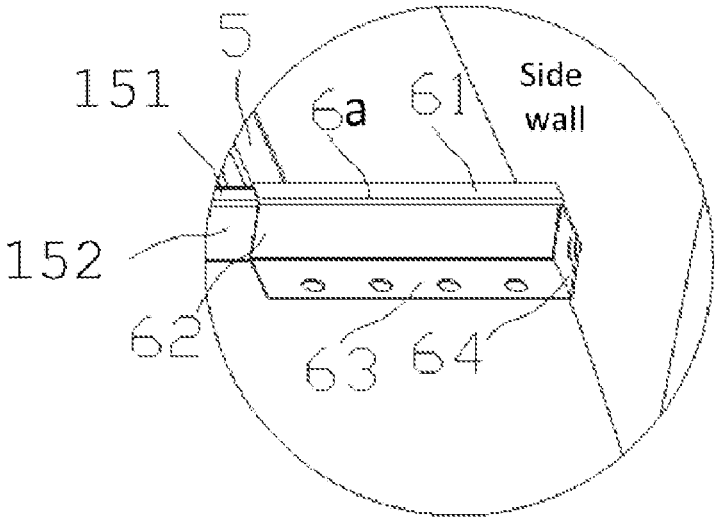
FIG. 26 is a mounting partial enlarged view when the gap filler is a Z-shaped strip in an embodiment of the present application.

As shown in FIG. 24 to FIG. 26, in some embodiments, the gap filler **6*a* is a strip having a Z-shaped cross section, the length thereof is greater than the distance between the outermost side of the base 5 and the side wall 16, a gap filler wall surface fixing plate 64 on the top end is fixed to the side wall 16, a gap filler upper surface 61 on the other end is attached to an upper surface 151 of the rear edge of the base 5, a gap filler middle vertical surface 62 is attached to a rear end surface 152 of the rear edge of the base, and a lower surface 63 of the gap filler 6*a* is attached to the ground. The inner vertical height thereof is the same as the height of the rear edge of the base 5, thereby ensuring the sealing of the lower gap between the base 5 and the side wall 16, and the upper gap is sealed by the sealing plate 13**.

FIG. 24 is a structure schematic view when the gap filler is a Z-shaped strip, in which a fixing plate 64 with the wall surface 16 is added.

FIG. 25 is a mounting schematic view when the gap filler is a Z-shaped strip, in which the panel 11 and the front and rear slopes 7 of the base are not shown.

FIG. 26 is a mounting schematic partial enlarged view when the gap filler is a Z-shaped strip in FIG. 25, in which the panel and the front and rear slopes 17 of the base are not shown.

In some embodiments, the length of the strip having a Z-shaped cross section may be the distance between the outermost side of the base 5 and the side wall plus 5 centimeters. Therefore, when mounting on side, the gap filler 6*a* of the strip having a Z-shaped cross section can satisfy the gap filling length between the outermost side of the base 5 and the side wall 16 without cutting, thereby ensuring the sealability and facilitating construction.

In some embodiments, the gap filler 6*a* may be a square tube having one end against the side wall 16 and the other end against the side of the base 5, and the square tube has the same height as the base 5.

The acting range of the gap filler can be quickly adjusted by a constructor on the construction site according to the distance between the base and the side wall, thereby ensuring the sealability and facilitating construction.

The width of the top side of the sealing plate 13 is not less than the sum of the distance between the outermost side of the base 5 and the side wall and the width of the panel hold-down strip 162.

The sealing plate 13 can be cut by a constructor on the construction side to adjust the width of the top side, so that the width of the top side of the sealing plate 13 mounted to the proper position is equal to the sum of the distance between the outermost side of the base and the side wall and the width of the panel hold-down strip. Therefore, the overall width of the water retaining device does not need to be strictly matched to the distance between the two side walls, and the overall width of the water retaining device can be adjusted within a wide range, thereby facilitating the prior measurement and on-site mounting construction.

As shown in FIG. 1, in some embodiments of the present application, the automatic water retaining device may further comprise a bulge 24 for limiting the floating angle of the panel 11, and the bulge 24 is disposed on the wall surface 16 on two sides of the automatic water retaining device.

As shown in FIG. 1, in some embodiments of the present application, the automatic water retaining device may further comprise a fixing rod 23 for preventing the base from turnover, wherein the fixing rod 23 is fixed to the wall surfaces on the two sides of the automatic water retaining device, and the bottom end thereof is fixed with one end of the outermost base with the first water inlet.

Figure 27:
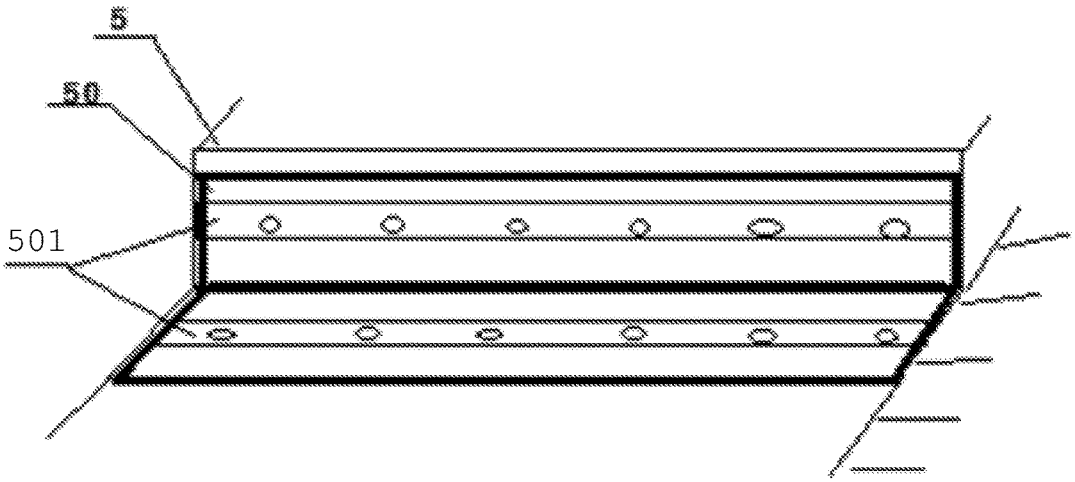
FIG. 27 is a connection structure schematic view of a base and a ground sealing strip in an embodiment of the present application.

As shown in FIG. 2 and FIG. 27, in some embodiments of the present application, a base anti-leakage flexible sealing strip 50 is disposed between the base 5 and the ground, the base anti-leakage flexible sealing strip 50 is deposed on one end of the base different from the first water inlet 10 (i.e., one end of the base away from the first water inlet 10), one end of the base anti-leakage flexible sealing strip 50 is detachably mounted to the base through the sealing strip hold-down strip 501, and the other end is detachably mounted to the ground through the sealing strip hold-down strip 501. The base anti-leakage water flexible sealing strip 50 in the present application is not limited to the above mounting manner, and may also be disposed horizontally, wherein one end is mounted to the bottom of the base, and the other end is mounted to the ground, as shown in FIG. 28.

All the hold-down strips in the embodiments of the present application are fixed by bolts or rivets.

Figure 29:
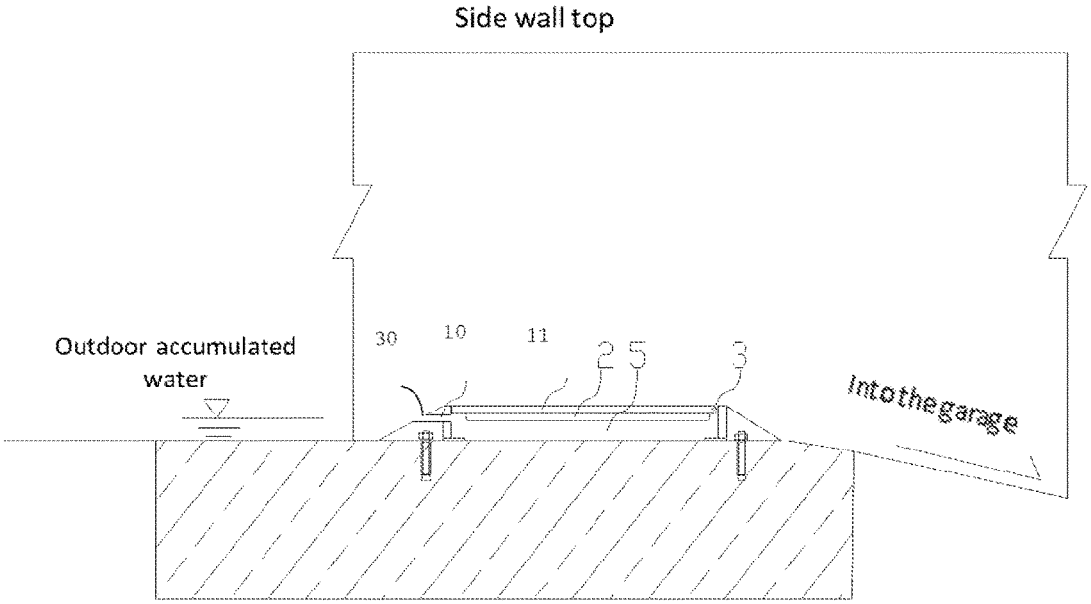
FIG. 29 is a structure schematic view of a water retaining device in an embodiment of the present application.
Figure 30:
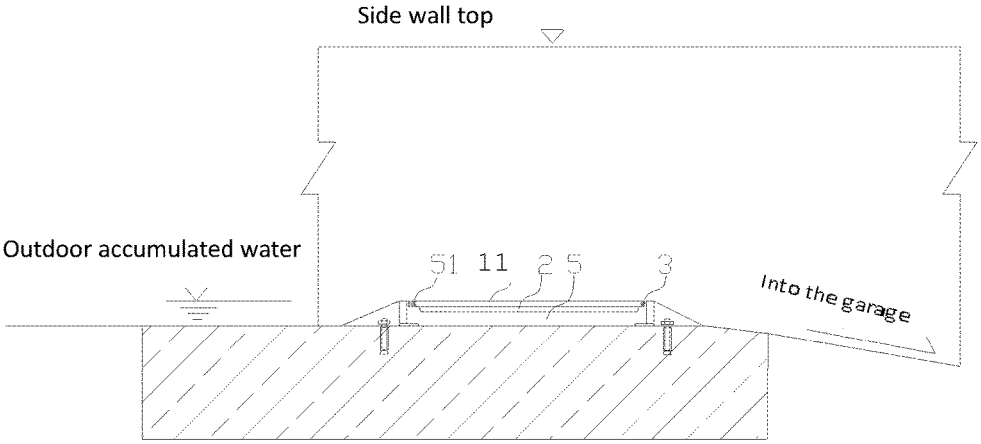
FIG. 30 is another structure schematic view of the water retaining device in an embodiment of the present application.
Figure 31:
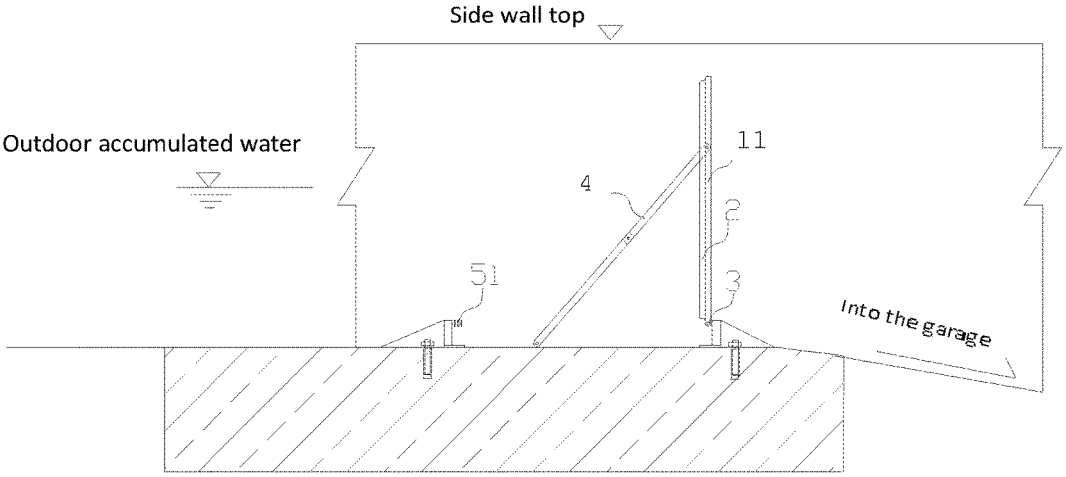
FIG. 31 is a structure schematic view when the water retaining device is in a water retaining state in an embodiment of the present application.
Figure 32:
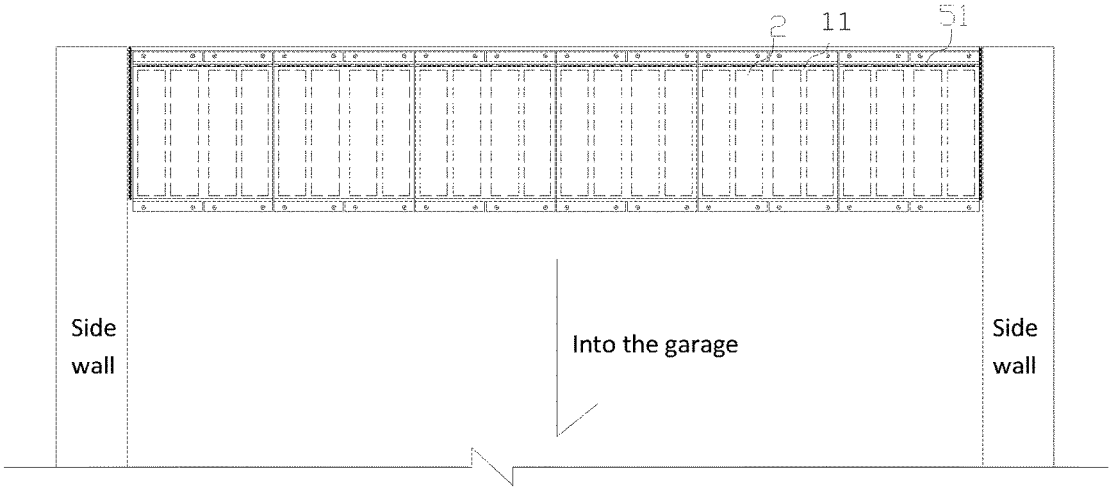
FIG. 32 is a plan schematic view of the water retaining device in an embodiment of the present application.

In order to minimize the effect on the vehicle access, the base of the water retaining device may be disposed as low as possible to reduce the height of the whole device. However, once a small amount of water enters the water storage cavity 5 at this time, the front end of the panel 11 is triggered to open upward along the hinge 3 to enter the water retaining state, and meanwhile, the normal passage of the vehicles is also stopped. In order to prevent the water retaining device from prematurely blocking the inlet passage and affecting the passage of the vehicles in the case of a small amount of water accumulation, the height of the lower edge of the first water inlet 10 from the ground can be raised. In some embodiments, the distance between the lower edge of the first water inlet 10 and the ground may be [3, 6] centimeters, for example, 4.5 centimeters, as shown in FIG. 29.

Alternatively, in order to prevent the water retaining device from blocking the inlet passage prematurely and affecting the passage of the vehicles, the first water inlet may be set as a grid structure and disposed on the upper surface of the base 5. As shown in FIG. 19, FIG. 20 and FIG. 30 to FIG. 32, by setting the first water inlet as a grid structure disposed on the upper surface of the base 5, only when the water level is higher than the upper edge of the base 5, the water can flow over the base 5 and enter the water storage cavity through the first water inlet 51 to open the panel 11, thereby performing the function that the panel 11 can be opened upward only when the water quantity at the front end of the base 5 reaches the water retaining threshold. The water retaining threshold at this time is the water level having an equal height as the base 5. The water retaining threshold depends on the drainage capacity of each application scenario and can be determined according to field experiments.

When the water quantity at the inlet is small and the depth of the accumulated water is small, the water retaining plate formed by the panel 11 is in the closed state, so that the vehicles can pass normally. Only when the water quantity at the inlet is large and the depth of the accumulated water is large, the front end of the panel 11 is opened upward along the hinge 3 to sufficiently block the water out of a garage.

The water inlet grid can ensure the opening sensitivity of the device by increasing the water inlet amount, and can also ensure the structural strength, thereby preventing the device from being crushed by the vehicles.

Figure 33:
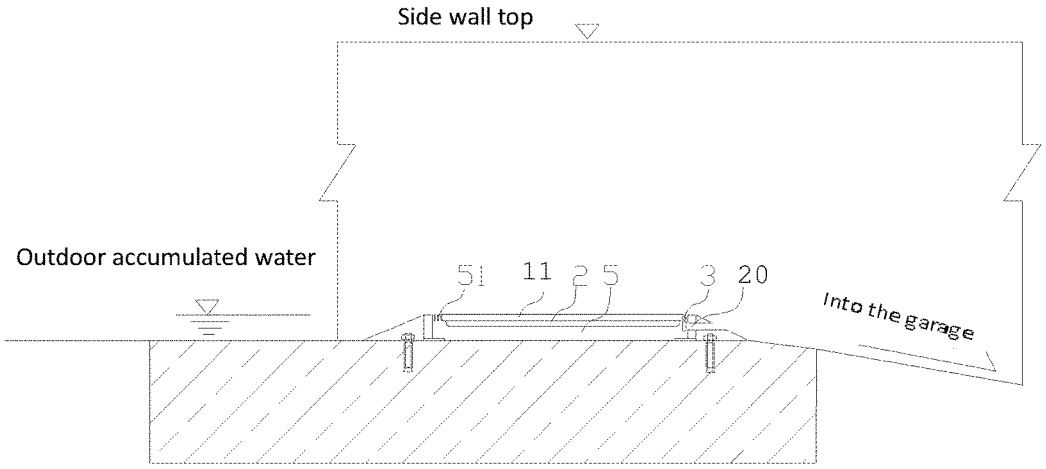
FIG. 33 is another structure schematic view of the water retaining device in an embodiment of the present application.

Besides, when the rear end of the base 5 is further provided with the first water outlet 20, as shown in FIG. 33, the time for opening the panel 11 can be further delayed to facilitate the passage of vehicles.

The above description is only the preferred embodiments of the present invention and is not intended to limit the present invention. Any modifications, equivalent substitutions and improvements made within the spirit and scope of the present invention should be included within the protection scope of the present invention.

What is claimed is:

1. An automatic water retaining device for blocking passage of water on the ground between two side walls, characterized by comprising two or more automatic water retaining units disposed in parallel, an automatic water retaining unit comprises a panel (11) and a base (5), wherein the base (5) is provided with a water storage cavity, the panel (11) is rotatably disposed on the base (5), the water storage cavity is opened and closed through rotation of the panel (11), a surface of the panel (11) for covering the base (5) is provided with a floating plate (2), a first end of the base (5) is composed of a different material than a second end of the base (5) connected with the panel (11) is provided with a first water inlet (10, 51) communicated with the water storage cavity, and when water enters the water storage cavity from the first water inlet (10, 51) and contacts the floating plate (2), buoyancy is generated to the floating plate (2) and the floating plate (2) drives the panel (11) to rotate and open under action of buoyancy, thereby implementing a water retaining function;

wherein one side of the base (5) connected with the panel (11) is provided with a drainage device, the drainage device comprises a first water outlet (20) disposed on the base (5) and communicated with the water storage cavity and a drainage switch (21) arranged at the first water outlet (20) and linked with the panel (11), and when the panel (11) covers the base (5), the drainage switch (21) is opened; and when the panel (11) rotates to open beyond a set angle, the drainage switch (21) is closed;

wherein the drainage switch (21) comprises a movable door (213), a guide rod (215), a switch spring (214) and a baffle plate (211) fixed to the panel (11), one end of the guide rod (215) is fixed to the base (5), the switch spring (214) and the movable door (213) are sleeved over the guide rod (215), one end of the guide rod (215) away from the end fixedly connected to the base (5) is fixed to the switch spring (214), one side of the movable door (213) opposite to the switch spring (214) is fixedly provided with an ejector rod (216), and the baffle plate (211) pushes the ejector rod (216) as the panel (11) rotates so that the movable door (213) slides back and forth along the guide rod (215) to open and close the first water outlet (20).

2. The automatic water retaining device according to claim 1, characterized in that the water inlet capacity of the first water inlet (10, 51) is greater than the drainage capacity of the first water outlet (20).

3. The automatic water retaining device according to claim 1, characterized in that the base (5) is fixedly mounted on the ground, and the automatic water retaining device further comprises buffer slopes (17) disposed on both sides of the base (5).

4. The automatic water retaining device according to claim 3, characterized in that a buffer slope (17) adjacent to a side of the first water outlet (20) is provided with a second water outlet (31) communicated with the first water outlet (20).

5. The automatic water retaining device according to claim 1, characterized in that the first water inlet (51) has a grid structure and is disposed on an upper surface of the base (5).

6. The automatic water retaining device according to claim 1, characterized in that a distance between a lower edge of the first water inlet (10) and the ground is 3-6 centimeters.

7. The automatic water retaining device according to claim 1, characterized by further comprising:

flexible sealing plates (1, 13) respectively disposed between both sides of the automatic water retaining device and both side walls, wherein the flexible sealing plates (1, 13) are respectively fixedly connected to side walls and the panel (11) of the automatic water retaining unit adjacent to the side wall in the automatic water retaining device, and after the panel (11) floats up, the flexible sealing plates (1, 13) are driven to bend therewith to implement water retaining between the two sides of the automatic water retaining device and the two side walls.

8. The automatic water retaining device according to claim 7, characterized in that a flexible sealing plate (13) has a right-angle trapezoidal structure, beveled side of the sealing plate (13) is fixedly connected to a side wall, a right-angle side is fixedly connected to one end of the panel (11) adjacent to the side wall in the water retaining unit adjacent to the side wall of the flexible sealing plate and a top side is flush with a rear edge of the base (5).

9. The automatic water retaining device according to claim 8, characterized by further comprising:

gap fillers (6*a*) respectively disposed between the two side walls and the base (5) adjacent to the two side walls, wherein one of the gap fillers (6*a*) has a same height as a height of the base (5), one end abuts against one of the side walls, the second end is hermetically fixedly connected to the base (5), a lower surface is hermetically fixedly connected to the ground, and the top side of the sealing plate (13) is disposed on an upper surface of one of the gap fillers (6*a*) and fixedly connected to another one of the gap fillers (6*a*).

10. The automatic water retaining device according to claim 7, characterized by further comprising:

a wall surface hold-down strip (161), a panel hold-down strip (162) and a gap filler hold-down strip (163), wherein a base angle of a beveled side of one of the sealing plates (13) is 45 degrees, the wall surface hold-down strip (161) fixes the beveled side of the sealing plate (13) to the side wall by 45 degrees along a side wall surface, the panel hold-down strip (162) is parallel to the side wall surface, right-angle side of the sealing plate (13) is fixed to an upper surface of the panel (11), and the gap filler hold-down strip (163) fixes a top side of the sealing plate (13) to an upper surface of one of the gap fillers (6*a*).

11. The automatic water retaining device according to claim 10, characterized in that a width of the top side of the sealing plate is not less than a sum of a distance between an outermost side of the base (5) and a side wall and a width of the panel hold-down strip (162).

12. The automatic water retaining device according to claim 7, characterized in that each of the flexible sealing plates (1) has a triangular structure, a bottom side of each of the flexible sealing plates (1) is fixedly connected to one end of the panel (11) adjacent to the side wall in the automatic water retaining unit.

13. The automatic water retaining device according to claim 1, characterized in that the base (5) is provided with two or more water storage cavities in parallel, and the device further comprises:

a beam (22) for separating the water storage cavities;

an upper connecting rod (433) of which one end is rotatably connected with the panel (11); and a lower connecting rod of which one end is rotatably connected with the beam (22) on the base (5), wherein the other end of the upper connecting rod (433) is hinged to the other end of the lower connecting rod.

14. The automatic water retaining device according to claim 13, characterized in that top of the beam (22) rotatably connected with the lower connecting rod is provided in longitudinal direction with a groove (421) for storing the upper connecting rod (433) and the lower connecting rod, the lower connecting rod comprises a left lower connecting rod (431) and a right lower connecting rod (432) which are respectively located on two sides of the upper connecting rod (433), one end of each of the left lower connecting rod (431) and the right lower connecting rod (432) is hinged to the upper connecting rod (433), and the other end of each of the left lower connecting rod (431) and the right lower connecting rod (432) is rotatably connected to inner walls on two sides of the groove (421).

15. The automatic water retaining device according to claim 1, characterized by further comprising an elastic device (54) disposed on one end of the base (5) adjacent to the first water inlet (10, 51) and capable of contacting the panel (11), wherein when the panel (11) is in a closed state, the panel (11) presses the elastic device (54).

16. The automatic water retaining device according to claim 1, characterized by further comprising a fixing rod (23) for preventing the base from turnover, wherein the fixing rod (23) is fixed to two side walls of the automatic water retaining device, and a bottom end of the fixing rod (23) is fixed to the second end of the base (5) of the automatic water retaining unit adjacent to the side wall with the first water inlet (10, 51).

17. The automatic water retaining device according to claim 1, characterized in that the panel (11) comprises an upper panel (101) on an upper layer and a lower panel (102) on a lower layer, the lower panel (102) is rotatably disposed on the base (5), the upper panel (101) is detachably mounted on the lower panel (102), and the floating plate (2) is fixed to the lower panel (102).

18. The automatic water retaining device according to claim 1, characterized in that a surface of the panel (11) covering the water storage cavity is further provided with a lightening hole (112), and the lightening hole (112) is filled with a buoyancy material.

* * * * *